United States Patent [19]

Klöckner

[11] Patent Number: 4,604,814

[45] Date of Patent: Aug. 12, 1986

[54] APPARATUS FOR COOLING OR DRYING COARSE-GRAINED BULK MATERIAL

[76] Inventor: Alfred Klöckner, Hirtscheider Str. 11, D-5239 Nistertal, Fed. Rep. of Germany

[21] Appl. No.: 593,969

[22] Filed: Mar. 27, 1984

[30] Foreign Application Priority Data

Mar. 30, 1983 [DE] Fed. Rep. of Germany ..... 3311693
Mar. 20, 1984 [EP] European Pat. Off. ..... 84103053.9

[51] Int. Cl.[4] ..... F26B 17/00; F26B 17/12

[52] U.S. Cl. ..... 34/172; 34/178; 34/236; 34/237; 198/365; 198/706; 198/802

[58] Field of Search ..... 34/172, 173, 178, 184, 34/236, 237, 238; 198/365, 560, 706, 802

[56] References Cited

U.S. PATENT DOCUMENTS

| | | | |
|---|---|---|---|
| 766,234 | 8/1904 | Fidell | 198/706 |
| 2,000,817 | 5/1935 | Bixby | 34/172 |
| 3,009,689 | 11/1961 | Hinz | 34/173 |
| 4,392,310 | 7/1983 | Hohman et al. | 34/172 |

FOREIGN PATENT DOCUMENTS

| | | | |
|---|---|---|---|
| 448575 | 8/1927 | Fed. Rep. of Germany | 34/172 |
| 2105215 | 12/1974 | Fed. Rep. of Germany . | |
| 3028263 | 4/1982 | Fed. Rep. of Germany . | |
| 2112913 | 6/1972 | France . | |

*Primary Examiner*—Albert J. Makay
*Assistant Examiner*—David W. Westphal
*Attorney, Agent, or Firm*—Robbins & Laramie

[57] ABSTRACT

The subject matter of the invention relates to apparatus for cooling or drying coarse-grained bulk material, comprising a plurality of trays mounted one above the other for rotation about a common axis, each tray being divided into a plurality of segments adapted to be tilted about a tilt axis extending in a radial direction of said common axis, means supporting said segments in the plane of the respective tray and permitting said segments to be tilted only within a determined angular range of rotation, and means for forcibly tilting each segment within said angular range. In prior art constructions, different means for forcibly tilting each segment in the said angular range have been required, depending on the time required by the feed material to pass through the cooling apparatus and on the number of trays employed in the cooling apparatus. Moreover, the hitherto known means for forcibly tilting the tray segments do not operate satisfactorily if the rotational speed of the trays in the cooling apparatus is increased. The apparatus according to the invention provides a solution to these problems by the use of an adjustable tilt lever.

16 Claims, 6 Drawing Figures

APPARATUS FOR COOLING OR DRYING COARSE-GRAINED BULK MATERIAL

Figure 1:
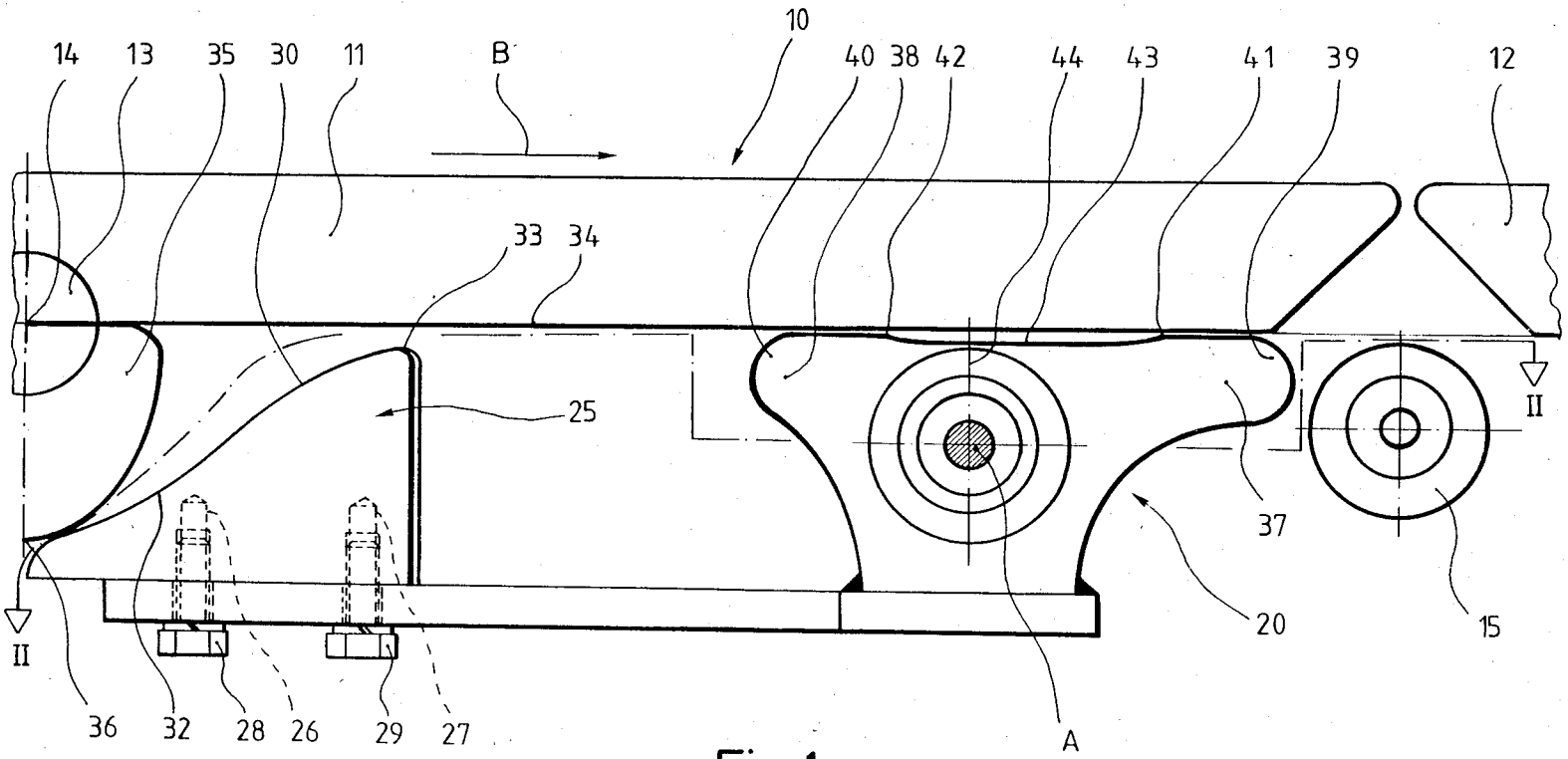

The present invention relates to apparatus for cooling or drying a coarse-grained bulk material, comprising a plurality of trays mounted one above the other for rotation about a common axis, each tray being divided into a plurality of segments adapted to be tilted about a tilt axis extending in a radial direction of said common axis, means supporting said segments in the plane of the respective tray and permitting said segments to be tilted only within an angular range of said rotation, said means including in association with each tray a tilt lever mounted for pivoting movement about a stationary tilt axis for tilting any one segment within said angular range, said tilt lever having a first lever arm projecting into the path of said segment support means, and a second lever arm adapted on pivoting said first lever arm to engage a respective segment for forcibly tilting it about its tilt axis.

An apparatus of the type referred to above has already become known from DE-PS No. 3,028,263. Apparatus of this type, also referred to as so-called cooling columns, are generally provided with at least two trays and above, up to about eight trays disposed above one another, depending on the available space, and particularly on the desired throughput. Cooling columns are preferably employed having a greater number of trays because of the more careful treatment of the feed material, better reshuffling of the feed material as it passes through the column, and particularly because of the higher throughput performance. Depending on the consistency of the feed material and other operating conditions, a pre-established time is desired for the feed material to pass through the column as it is dried or cooled. This implies that the trays of a cooling column having a greater number of trays have to rotate at a higher speed than those of a column having for instance only two trays, if the feed material is to be discharged from the column after the same treatment interval. It may thus be generally stated that cooling columns having a greater number of trays rotate at a higher speed than those having a smaller number of trays. The higher rotational speed of the trays of a cooling column necessarily result in an increase of the forces acting between the tilt lever and a given tray segment for tilting the segment in order to transfer the material resting thereon onto the subjacent tray. The increased forces result in increased wear of the parts coming into engagement with one another, and usually also in the generation of considerable noise, both of which should be avoided as far as possible. Higher rotational speeds result in the further problem that each segment takes a shorter time for passing through the angular range within which it is to be tilted. This may lead to the feed material, which has itself a certain inertia, not being able to drop from the respective segments in the course of the tilting operation. This again may result in an undesirable congestion of the feed material and consequential jamming of the entire column. But even in the case of a cooling column having a smaller number of trays, for instance two, the tilt lever has to be correctly dimensioned in view of the desired rotational speed and circumferential speed of the trays so as to avoid that a tilted segment for instance remains in its tilted position for too long a period, as this would be disadvantageous for the guidance of the air flow within the column and would thus affect the efficiency of the cooling or drying operation. In view of these and other factors, different tilt levers are required for different types of cooling columns and for varying operating conditions of any cooling column, this requirement being considered a considerable disadvantage.

It is therefore an object of the present invention to improve an apparatus of the type set forth in the introduction in such a manner that reliable operation thereof is ensured even at increased rotational speeds of the respective trays.

In apparatus of the type set forth in the introduction, this object is attained according to the invention by providing that the first lever arm of the tilt lever is adjustable in the direction of rotation of the trays relative to the second lever arm.

In this manner it is possible at higher rotational speeds to advance the location and thus the point of time at which a segment is tilted within the tilting zone relative to the tilt axis of the tilt lever in a direction opposite to the direction of rotation of the trays. As each segment is tilted back to its horizontal position as it reaches the angular location of the tilt axis of the tilt lever, the provision referred to above permits the distance between the locations at which the tilting movement is initiated and whereat the return tilting movement is completed, respectively, to be increased. As the trays rotate at a predetermined speed, this results in an extension of the period during which any given segment is in its tilted position. As a further essential advantage achieved by this provision, there is only one type of tilt lever required for different types of cooling columns and for varing operating conditions thereof.

In a preferred embodiment, the first lever arm may comprise a cam plate secured to a plate member connected to the second lever arm. In this case the cam plate is adjustably secured to the plate member. In a particularly advantageous embodiment of this type, the cam plate may be adapted to be screwably secured to the plate member at different discrete positions.

It has also been found particularly advantageous to form the cam plate with a cam face extending in the non-tilted position of the tilt lever from a point lying at a lower level than the tilt axis of the tilt lever upstream of the tilt axis with respect to the direction of rotation of the trays to a point located a small distance below the respective tray. As in this case the segment support means come into engagement with the cam plate at the lowermost point of the cam face, the location of the point of engagement and the configuration of the cam face together result in that practically the full engagement force is converted into a force for tilting the tilt lever without the exertion of an excessive load on the tilt lever. If furthermore the cam face is advantageously designed in the form of an inclined rectilinear flank or in the shape of a hyperproportionally rising curve, it is possible to achieve a steady acceleration of the tilt lever up to its end position.

In order to achieve a smooth sliding engagement between the segment support means and the tilt lever cam plate, the segment support means may preferably be provided with second cam plates formed for instance in the shape of a half-ellipse with its apex pointing downwards. In this manner it is ensured that the point of engagement between the first cam plate of the tilt lever and the second cam plates associated with the segment support means is continuously displaced during the tilting movement of the tilt lever.

The tilting lever is customarily located within the tilting range at a location resulting in a segment being tilted immediately after entering the tilting range. If it were now intended, departing from a given position of the tilt axis of the tilt lever, to shift the point of engagement between the tilt lever and a segment to be tilted relative to the tilt axis of the tilt lever in a direction opposite to the direction of rotation of the trays in the case of higher rotational speeds thereof, the tilt lever would attempt to tilt the segment at a position whereat it is not yet released for tilting. For this reason the invention provides in an advantageous embodiment thereof that the substantially radially aligned tilt axis of the tilt lever is adjustably mounted in the direction of rotation of the trays. This enables the tilt axis of the tilt lever to be relocated in the direction of rotation by the same angle by which the point of engagement between the tilt lever and a segment is advanced in a direction opposite to the direction of rotation. In this context it has been found advantageous to choose a design permitting the tilt axis to be adjusted to different discrete positions. In a particularly simple embodiment this may be achieved by forming the housing wall of the cooling apparatus with a plurality of bores aligned in the direction of rotation for adjustably mounting the tilt axis of the tilt lever.

The adjustment of the cam plate of the first lever arm in a direction opposite to the direction of rotation of the trays in relation to the tilt axis of the tilt lever necessarily results in an increased distance between the cam plate and the tilt axis of the tilt lever. This leads to an increased reduction of the angle by which the tray segment is forcibly tilted by the tilt lever. Depending on the properties of the feed material to be dried, which may adhere more or less strongly to the segment, this reduced tilting angle may result in not all of the feed material dropping off the tilted segment. This problem may be solved according to the invention by providing that the cam plate is extended in the direction towards the tilt axis of the tilt lever by a projection extending in the direction of the tray segments towards said tilt axis, so that the end of the projection facing towards the tilt axis is located at a predetermined maximum spacing from the tilt axis of the tilt lever in the direction of rotation of the trays as the first lever arm is adjusted to its maximum spacing from the tilt axis of the tilt lever. As a result, the respective tray segments continue to be tilted as long as the second cam plate associated with the respective segment support means is in engagement with said projection. In this manner it is possible to achieve a predetermined tilting angle at each position of the cam plate of the first lever arm relative to the tilt axis of the tilt lever.

The upper surface of the projection preferably forms an extension of the cam face of the cam plate. It has been found advantageous to design the extension of the cam face extending along the projection so that it is substantially parallel to the underside of the trays in the non-tilted position of the tilt lever.

Figure 2:
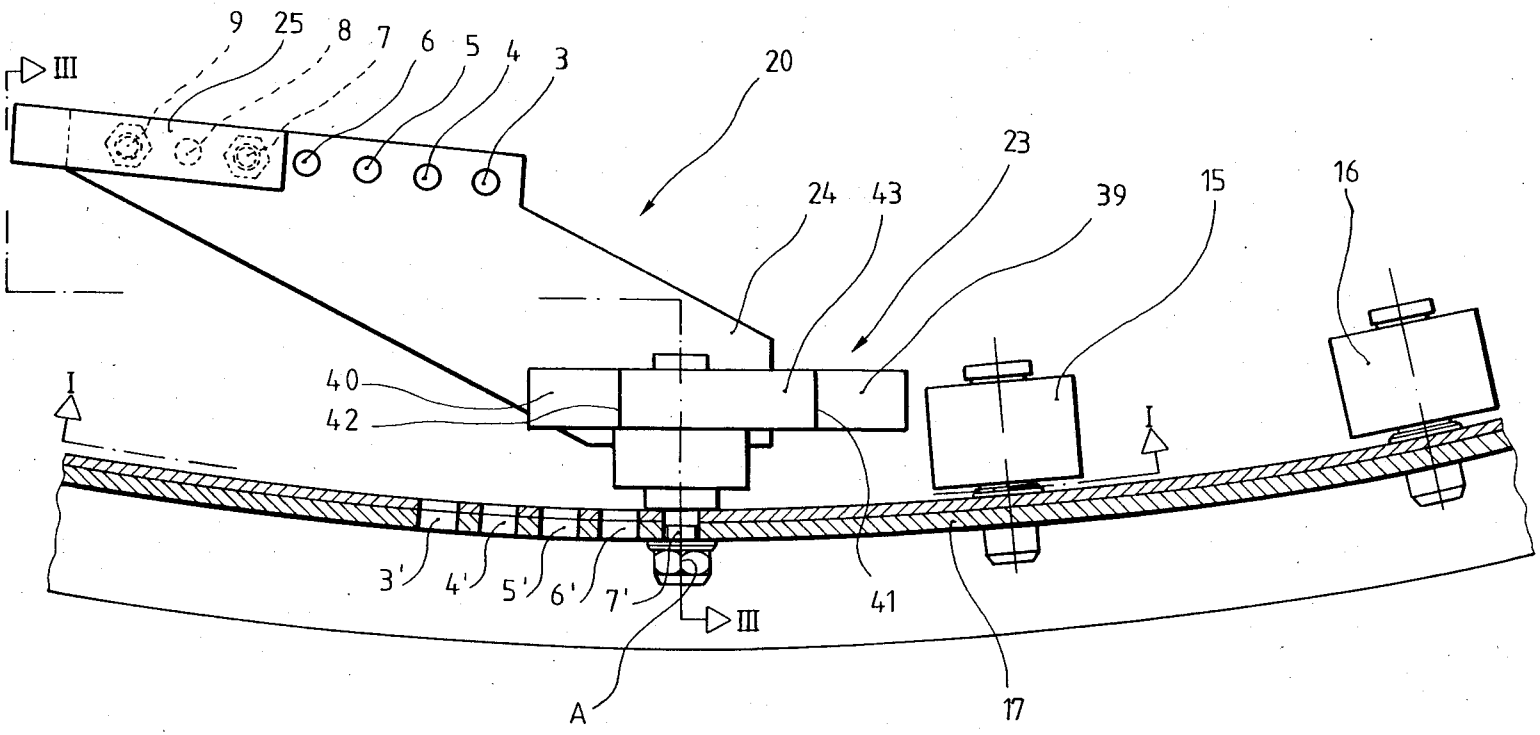
Figure 3:
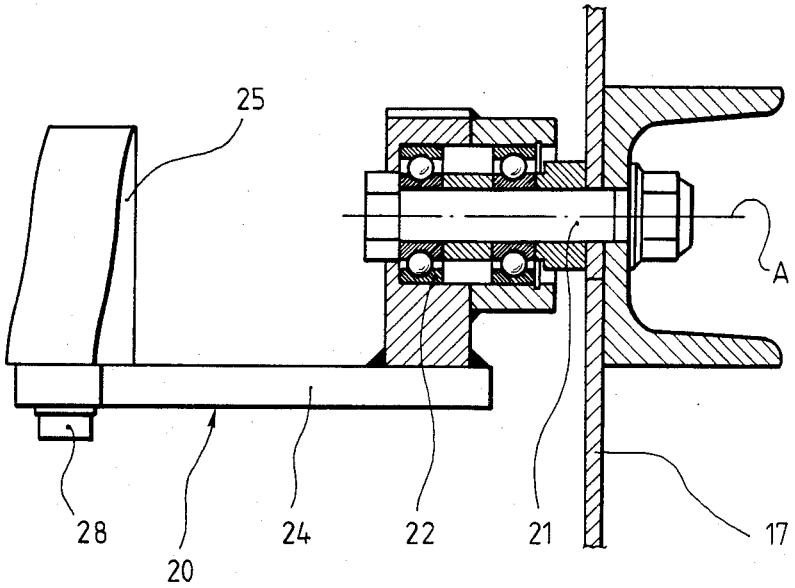
Figure 4:
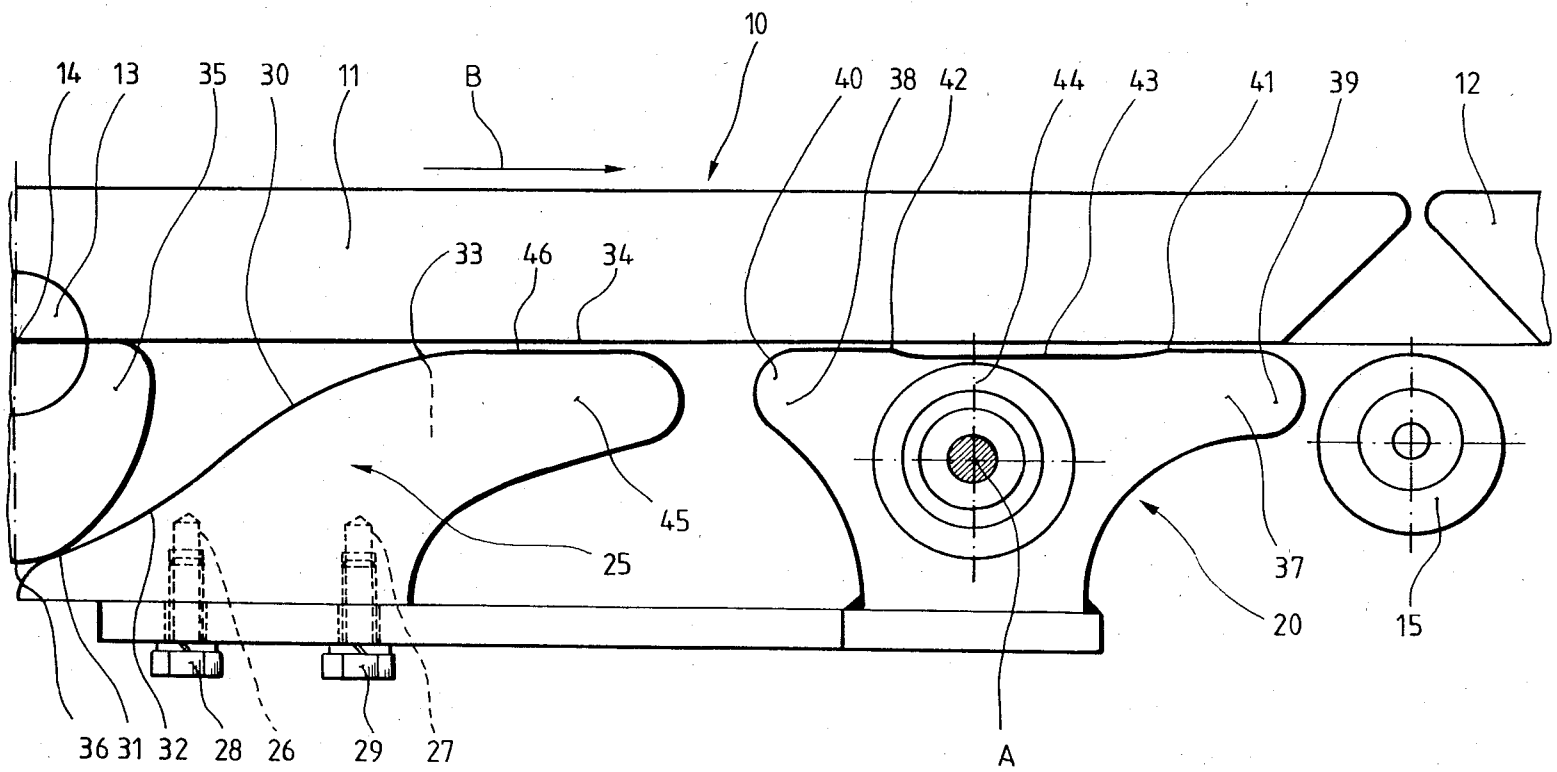
Figure 5:
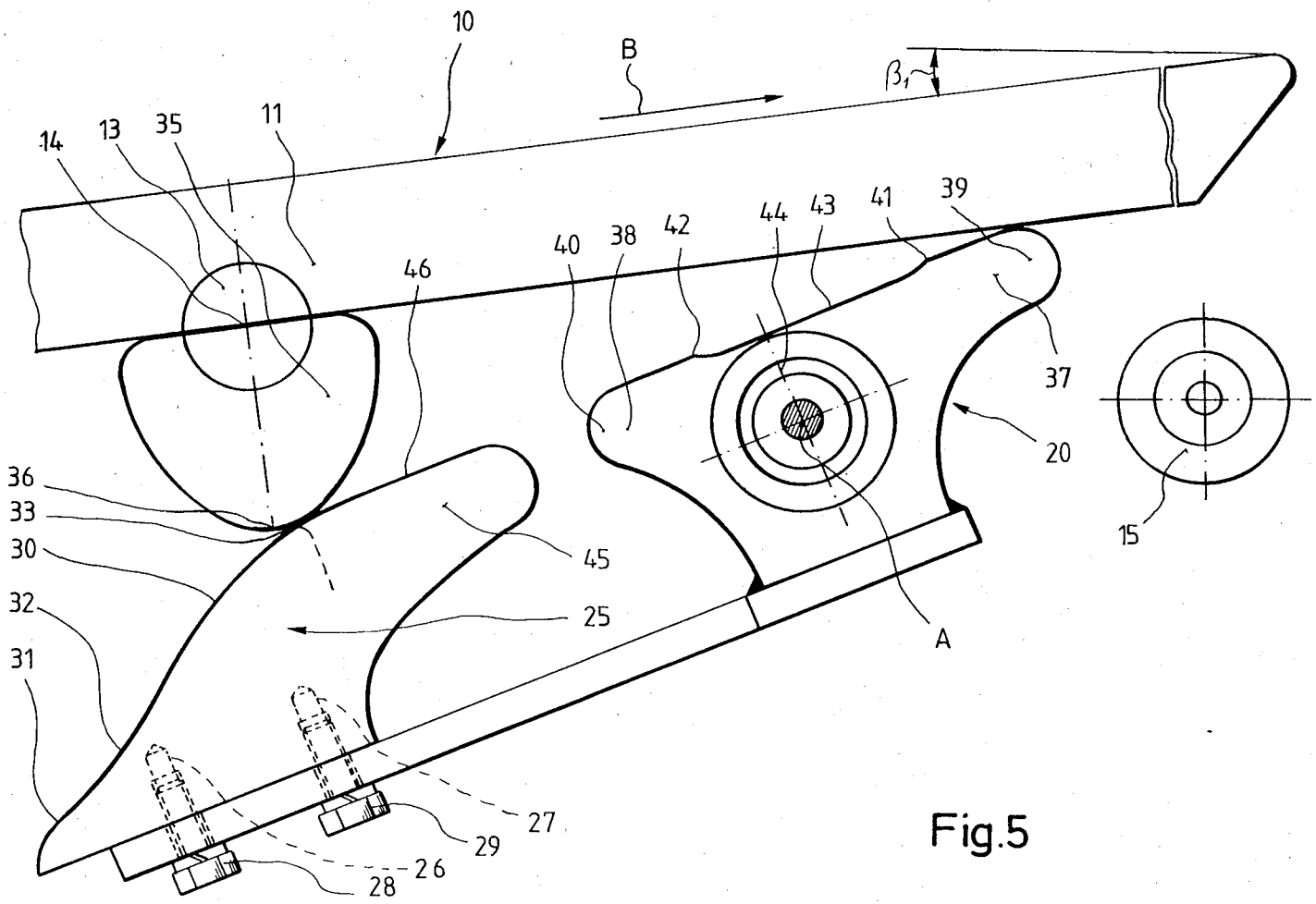
Figure 6:
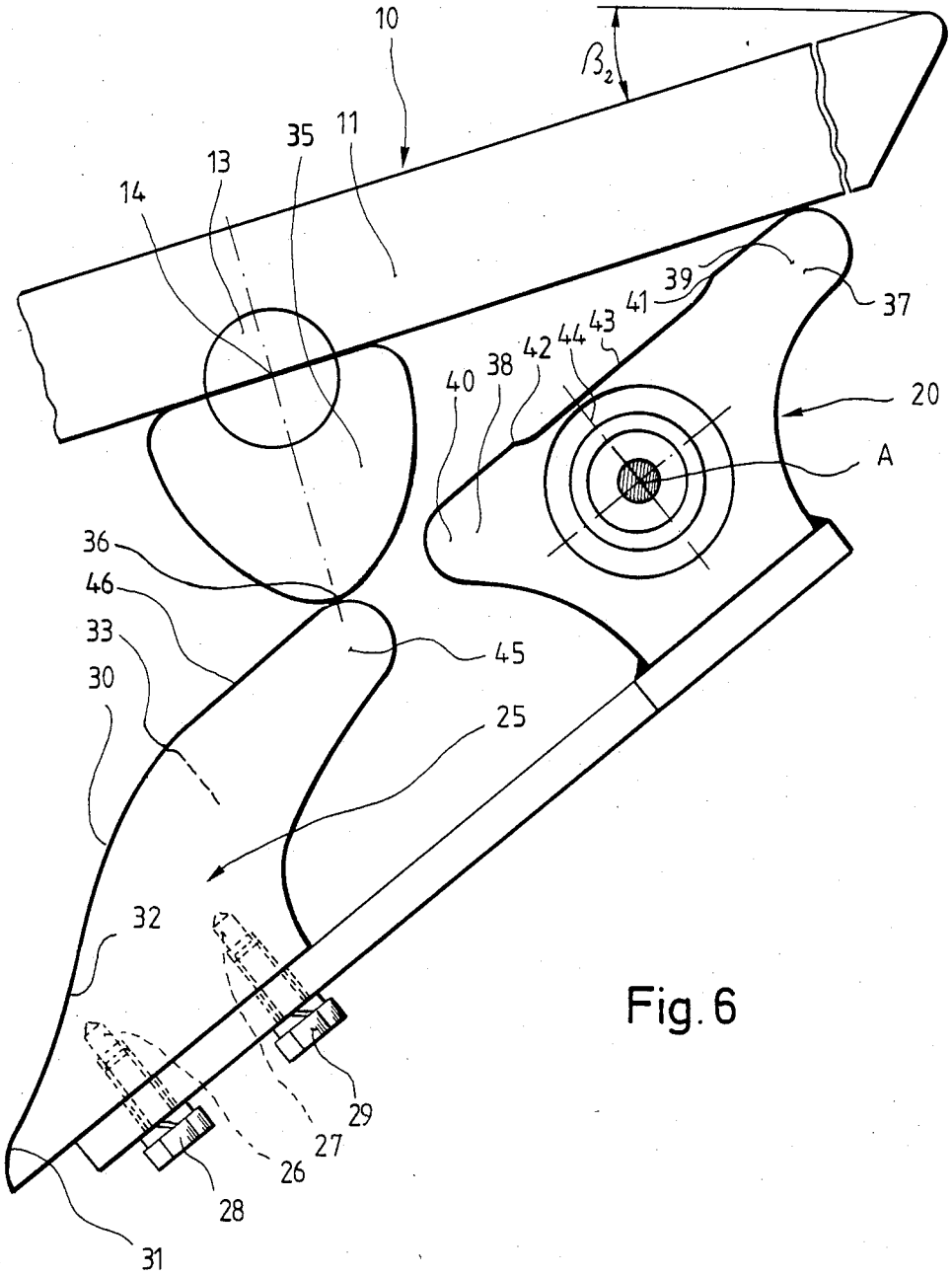

A preferred exemplary embodiment of the invention shall now be described in detail with reference to the accompanying drawings, wherein:

FIG. 1 shows a front view of a tilt lever and a tray segment passing thereabove still in its horizontal position as viewed from the line I—I in FIG. 2, FIG. 2 shows a top plan view of the tilt lever shown in FIG. 1, with the wall of the cooling column shown in section along the line II—II in FIG. 1, FIG. 3 shows a side view of the tilt lever shown in FIGS. 1 and 2 partially sectioned along the line III—III in FIG. 2, FIG. 4 shows a view corresponding to FIG. 1 of an embodiment including a modified first lever arm, and FIGS. 5 and 6 show front views corresponding to FIG. 1 with a tray segment in different tilted positions.

Shown in FIG. 1 is a first tray generally designated 10 and including a plurality of segments only two of which are partially shown as at 11 and 12. Segment 11 is secured to support means 13 extending substantially perpendicular to the plane of the drawing in a radial direction with respect to an axis of rotation (not shown) of tray 10. Segment 11 is mounted for tilting movement about the axis 14 of support means 13 from its horizontal position shown in FIG. 1 to a substantially inclined position.

The circular tray 10 is usually comprised of about twelve, sixteen or even more segments such as those indicated at 11 and 12. During rotation of tray 10, the segments are normally supported on rollers rotatably mounted in a common plane along the interior periphery of a housing 17 of the cooling column, only two of such rollers being shown in FIG. 2 as at 15 and 16. Only a predetermined angular sector of the cooling column is not provided with such rollers for supporting the tray segments. This sector substantially corresponds to the area of a single segment 11, 12. Provided within this sector, designated as the tilt sector in the following, is a tilt lever 20 generally indicated at 20 mounted on a bolt 21 secured to housing wall 17 of cooling column for oscillating tilting movement about a tilt axis A as shown in FIG. 3. Tilt lever 20 is tiltably mounted on bolt 21 by means of a pair of ball bearings 22.

Tilt lever 20 generally comprises a plate 23 extending substantially in a plane perpendicular to tilt axis A, a plate member 24 secured to the lower end of plate 23, and a first cam plate 25 disposed at a location inwardly offset with respect to plate 23 towards the axis of rotation of the cooling column and likewise extending in a substantially vertical plane. In relation to plate 23, cam plate 25 is offset by a certain distance in a direction opposite to the direction of rotation (indicated by arrow B in FIG. 1), and slightly tilted with respect thereto about a vertical axis by an angle of about 6° opening in the direction opposite to the direction of rotation B. Cam plate 25 as well as plate 23 preferably extend along a circular arc around the axis of rotation of the cooling column. Plate member 24 is formed with bores 3 to 9 at about 20 mm spacings along a line preferably extending along a circular arc about the axis of rotation of the cooling column. Cam plate 25 has its lower surface formed with a pair of threaded bores 26, 27 extending upwards into cam plate 25 at a spacing of about 40 mm for receiving a pair of threaded bolts 28 and 29, respectively extending through plate member 24 for securing cam plate 25 at a substantially vertical position to the substantially horizontally extending plate member 24. In the position shown in FIGS. 1 and 2, cam plate 25 is secured to plate member 24 by bolt 29 extending through bore 7 thereof. From this position, cam plate 25 may be shifted to the right in FIG. 2 by inserting bolt 29 through bores 6 to 3, giving the possibility of five different positions for cam plate 25.

Housing wall 17 of the cooling column is formed with a series of bores 3' to 7' along a horizontal circular arc in a predetermined relationship to the adjustment possibilities of cam plate 25 provided by bores 3 to 7 in plate member 24. Bores 3' to 7' permit bolt 21 carrying tilt lever 20 to be shifted in position along the housing wall. Bores 3' to 7' are likewise formed at spacings of about 20 mm.

The upper edge of cam plate 25 is formed as a cam face 30 extending from a forwardly located point 31 in the direction of rotation along a slightly curved rise portion 32 to a point 33 slightly below the lower edge 34 of segment 11. Cooperatively associated with cam face 30 is a second cam plate 35, one of which is secured to each segment support means 13. Second cam plate 35 may be of any suitable configuration and of a size ensuring that its lower end 36 lies substantially at the same level as the lowermost point 31 of cam face 30 in the non-tilted position of tilt lever 20 as well as of segment 11 about to be tilted.

Preferably, second cam plate 35 is designed in the form of a half-ellipse the axes of which are aligned in the horizontal and vertical directions, and one apex of which forms the lower end 36 of cam plate 35. This configuration of second cam plate 35 has been found particularly effective for cooperation with first cam plate face 30 of a shape as shown in FIG. 1. Cam face 30 of first cam plate 25 may also of course by formed as a rectilinear edge extending at an upwards inclined angle with respect to the horizontal. In each case, however, cam face 30 is suitably designed so that in the non-tilted position of tilt lever 20 its lowermost point 31 lies at a level below that of tilt axis A. In this manner it is ensured that the force generated by the engagement of second cam plate 35 with first cam plate 25 is fully converted to a tilting momentum acting on the tilt lever.

In the radial direction of segments 11 and 12, the dimension of second cam plate 35 is selected so that on rotation of tray 10 it comes into contact solely with first cam plate 25, but not with plate 23.

Plate 23 is formed with a first projection 37 extending in the direction of rotation, and a second projection 38 extending in a direction opposite to the direction of rotation with respect to tilt axis A. First projection 37 is formed with a second cam face 39, and second projection 38, with a third cam face 40. Both these cam faces come into contact with the lower surface 34 of each segment as the respective segment is to be tilted from and back to its horizontal position, as will be explained in detail hereinafter. The second and third cam faces are each formed with substantially flat top sections 41 and 42, respectively, while a top surface portion 43 extending between these raised top sections is recessed with respect thereto.

The described tilt lever generally operates as follows: During rotation of tray 10 in the direction of rotation B, segment 11 in horizontal position enters the tilt sector. Entry into the tilt sector is defined by the engagement of second cam plate 35 with first cam plate 25 and the beginning of its upward movement along first cam face 30. In this position segment 11 is no longer supported by rollers corresponding to the ones designated 15 and 16. The upwards movement of second cam plate 35 along cam face 30 of first cam plate 25 results in tilt lever 20 being progressively tilted counterclockwise about tilt axis A as shown in FIG. 1. In this case, first cam plate 25 effectively acts as a first lever arm of tilt lever 20 operatively engaged by second cam plate 35 connected to support means 13 of segment 11. First projection 37 of plate 23 acts as a second lever arm of tilt lever 20 engaging lower surface 34 of segment 11 in response to the progressive tilting of tilt lever 20 for forcibly tilting segment 11 about axis 14 of support means 13 in the counterclockwise direction. This causes the feed material (not shown) resting on segment 11 to drop onto a not shown subjacent tray of the cooling column, or from the lowermost tray of the cooling column to a likewise not shown discharge port thereof. During each tilting cycle, tilt lever 20 is preferably not tilted by an angle of 90°, but only by a smaller angle of about 50° to a position defined by the engagement with a not shown stop member.

The return tilting movement of segment 11 is initiated during further rotation of tray 10 by the lower edge 34 of the tilted segment 11 extending to the left of segment tilt axis 14 in FIG. 1 and being not shown in this figure coming into engagement with third cam face 40 of second projection 38 of tilt lever 20. As a result, segment 11 is progressively tilted in a clockwise direction about its tilt axis 14 to a position in which its lower surface 34 contacts both top sections 42 and 41 of plate 23. (The segments are preferably tilted only to a position corresponding to the tilted position of the tilt lever. In this case, the segment comes into simultaneous engagement with both top sections 41 and 42 of the tilt lever.) Departing from this position, further rotation of tray 10 results in segment 11 and tilt lever 20 being simultaneously tilted back to their horizontal positions. This horizontal position is attained as or before tilt axis 14 of segment 11 passes a vertical plane through tilt axis A of tilt lever 20 as indicated by a vertical line 44 in FIG. 1.

The time during which segment 11 is in its tilted position is thus defined by the time it takes for tilt axis 14 of segment 11 to move from the position in FIG. 1, in which second cam plate 35 just contacts first cam plate 25, to the point at which it passes through the vertical plate 44 passing through tilt axis A of tilt lever 20 as shown in FIG. 1. This time again depends on the speed of rotation of the cooling column trays or rather, in consideration of different diameters of such cooling columns, on the circumferential speed of the segments at their radially outer edges. As already explained in the introduction, the cooling or drying time of a feed material passing through a cooling column of this type is dependent on the type of the material fed to the cooling column and on the condition of the feed material. This means that the length of the treatment is determined by the properties of the feed material itself. In a cooling column having only two trays, the rotational speed of the trays has to be reduced, resulting in a longer dwelling time of the feed material on each tray as compared to the case of a cooling column having for instance six trays, in which case the rotary speed of the trays has to be increased, and the dwell time of the feed material on each tray to be correspondingly abbreviated if the same overall dwell time of the feed material in the cooling column is to be obtained. The following table shows the dwell time of the feed material on each tray of a cooling column having a diameter of 225 cm and the peripheral speeds of the trays for achieving an overall treatment time of seven minutes in different cooling columns having three, four, five and six trays, respectively.

TABLE I

| Number of trays | 3 | 4 | 5 | 6 |
|---|---|---|---|---|
| Dwell time on each tray, min. | 2.33 | 1.75 | 1.4 | 1.16 |
| Circumferential speed cm/min | 303 | 404 | 505 | 609 |

From this table it is evident that the circumferential speed is doubled by increasing the number of trays in a cooling column from three to six. This implies also that the time during which each segment is in its tilted position is reduced to one-half. In order, however, to keep the time for which each segment is in its tilted position substantially constant under varying conditions and irrespective of the number of trays employed, the invention provides the possibility to adjust first cam plate 25 in the direction of rotation B or opposite thereto, respectively. If first cam plate 25 is mounted at a position in which bolt 29 extends through bore 3 of plate member 24, the distance in the direction of rotation between the first-engagement point 31 of cam face 30 and tilt axis A of tilt lever 20 is rather small. This position is thus suitable for slowly rotating cooling columns or for cooling columns having a small number of trays. The more the rotational speed increases, as generally in the case of cooling columns having a greater number of trays, the more has the cam plate 25 to be advanced opposite to the direction of rotation B. FIG. 2 shows first cam plate 25 in its furthest advanced position, i.e. with the greatest distance between it an tilt axis A of tilt lever 20. As long as tilt axis A of tilt lever 20 is left stationary at its original position, this adjustment of first cam plate 25 results in a segment being tilted immediately upon entering the tilting sector. With first cam plate 25 in one of the remaining positions defined by bores 6 to 3, the segment is tilted at a progressively later time after entering the tilting sector. If it is now considered desirable or essential that a segment be tilted immediately after entering the tilting sector independently of the circumferential speed of the respective tray 10, tilt axis A of tilt lever 20 may be displaced in the direction of rotation opposite to the direction of adjustment of first cam plate 25. If tilt axis A of tilt lever 20 is initially positioned for instance in bore 3', this position would correspond to the position of first cam plate 25 determined by bore 3 of plate member 24. If departing from this position first cam plate 25 is adjusted opposite to the direction of rotation to the position determined by bore 4, tilt axis A of tilt lever 20 would have to be relocated accordingly to bore 4', until finally a position of cam plate 25 determined by bore 7 corresponds to the location of tilt axis A adjacent bore 7' as shown in FIG. 2.

A faster rotational speed of the trays may not only be required due to a greater number of trays, but also due to the properties of the feed material to be treated and the time required for the feed material to pass through the cooling column for achieving complete treatment. This time generally resides between about 6 and 20 minutes.

Thanks to the novel construction of the tilt lever described, only a single type of tilt lever is now required for cooling columns of any type and for varying operating conditions. This results in a considerable saving of costs for otherwise storing a variety of such tilt levers.

The embodiment shown in FIG. 4 differs from the one depicted in FIG. 1 only by first cam plate 25 being extended by a projection 45 extending towards tilt axis A of tilt lever 20 in the direction of rotation of tray 10. Projection 45 mainly serves the purpose of extending cam face 30 beyond point 33 by a cam face portion 46. In the non-tilted position of tilt lever 20, cam face portion 46 extends substantially parallel to the lower surface of tray 10. FIGS. 4 to 6 show cam plate 25 at a position of maximum spacing from tilt axis A of tilt lever 20 in the direction of rotation B of tray 10. If in this position cam plate 25 were not provided with projection 45, as in the embodiment shown in FIG. 1, the segment 11 to be tilted would be forcibly tilted to a maximum tilting angle $\beta$, as shown in FIG. 5, corresponding to a position in which the lowermost end 36 of second cam plate 35 contacts the uppermost point 33 of cam face 30. Continued rotation of tray 10 would then not result in further forcible tilting of the respective segment.

FIG. 6 shows a condition of the tray segment to be tilted and the tilt lever in which tray 10 has been advanced from the position shown in FIG. 5 by a certain angle of rotation, so that lower end 36 of second cam plate 35 is now in contact with the distal end of cam face portion 46 of projection 45. In this position tray segment 11 has been forcibly tilted by a greater angle $\beta_2$. In this manner it may be ensured that a feed material to be dried or cooled which has somewhat sticky properties or is of a chip-like structure, such as scales, wafers or the like, is enabled to completely slip off the tray segment.

Extension 45 of first cam plate 25 does not per se interfere with the proper functioning even if cam plate 25 is adjusted to a position closer to tilt axis A of tilt lever 20. In this case, a tray segment to be tilted is merely forcibly tilted by a greater angle to a nearly vertical position. Solely in the most extreme cases requiring a very large adjustment range of cam plate 25 for accommodating a very large range of rotational speed variation it may be necessary to provide cam plates having extensions 45 of different length for certain adjustment ranges.

I claim:

1. Apparatus for cooling or drying of coarse-grained bulk material, comprising a plurality of substantially planar trays mounted one above another for rotation in one direction about a common axis, each tray being divided into a plurality of segments adapted to be tilted about a tilt axis extending in a radial direction of said common axis, means supporting said segments along a path in the plane of the respective tray and permitting said segments to be tilted only within an angular range of said rotation, said means including in association with each tray a tilt lever mounted for pivoting movement about a stationary tilt axis for tilting any one segment within said angular range, said tilt lever having a first lever arm projecting into the path of said segment support means, and a second lever arm adapted on pivoting said first lever arm to engage a respective segment for forcibly tilting it about its tilt axis, characterized in that said first lever arm (25, 24) of said tilt lever (20) is adjustable in the direction of rotation of said trays (10) relative to said second lever arm (23, 39).

2. Apparatus according to claim 1, characterized in that said first and second lever (24, 25; 23, 39) are disposed at radially offset positions relative to one another.

3. Apparatus according to claim 2, characterized in that said first lever arm (24, 25) comprises a cam plate (25) secured to a plate member (24) connected to said second lever arm (23, 39).

4. Apparatus according to claim 3, characterized in that said cam plate (25) is adapted to be screwably secured to said plate member (24) at different discrete positions.

5. Apparatus according to claim 4, characterized in that said cam face (30) of said cam plate (25) is extended in the direction of said tilt axis (A) by a projection (45) extending in the direction of rotation (B) of said trays (10) towards the tilt axis (A) of said tilt lever (20), so that the end of said cam face (30, 46) facing towards said tilt axis is located at a predetermined maximum spacing in the direction of rotation of said trays from the tilt axis of said tilt lever as said first cam plate (25) is adjusted to its maximum spacing from the tilt axis (A) of said tilt lever (20).

6. Apparatus according to claim 5, characterized in that the extension (46) of said cam face (30) formed on said projection (45) extends substantially parallel to the underside of the respective tray (10) in the untilted position of said tilt lever.

7. Apparatus according to claim 3, characterized in that said cam plate (25) has a cam face (30) extending in the non-tilted position of said tilt lever (20) from a point (31) lying at a lower level than said tilt axis (A) of said tilt lever (20) upstream of said tilt axis in the direction of rotation (B) of said trays (10) to a point (33) located a small distance below the respective tray (10).

8. Apparatus according to claim 7, characterized in that said cam face (30) is of an inclined rectilinear configuration.

9. Apparatus according to claim 7, characterized in that said segment mounting means (13) are provided with second cam plates (35) affixed thereto for cooperation with said cam plate (25) of said first lever arm, the projecting lower end of said second cam plates in the non-tilted condition of the respective segment extending substantially to the level of the lower end (31) of the cam face (30) of said cam plate (25).

10. Apparatus according to claim 9, characterized in that said second cam plates (35) are shaped as a half-ellipse with its apex pointing downwards.

11. Apparatus according to claim 7, characterized in that said cam face (30) has the shape of a hyperproportionally rising curve.

12. Apparatus according to claim 1, characterized in that the substantially radially extending tilt axis (A) of said tilt lever (20) is adjustably mounted in the direction of rotation of said trays (10).

13. Apparatus according to claim 12, characterized in that said tilt axis (A) is adjustable to different discrete positions (3' to 7').

14. Apparatus according to claim 13, characterized in that said tilt axis (A) is adjustable in the direction of rotation by predetermined rotary angles corresponding to identical angular adjustments of said first lever arm (25) opposite to said direction of rotation (B).

15. Apparatus according to claim 14, characterized in that the housing wall (17) of said cooling apparatus is formed with a plurality of bores (3' to 7') aligned in the direction of rotation for adjustably mounting said tilt axis (A) of said tilt lever (20).

16. Apparatus according to claim 1, characterized in that said second lever arm comprises a cam plate (23) having a first projection (37) pointing in the direction of rotation and a second projection (38) pointing away from said tilt axis (A) opposite to said direction of rotation and adapted in the tilted position of said tilt lever (20) and a respective segment (11, 12) to be engaged by said segment during rotation of the respective tray for progressive return tilting movement of said tilt lever in combination with said segment, points (41, 42) of said projections (37, 38) remote from said tilt axis (A) being located in the non-tilted position of said tilt lever at a greater vertical spacing from said tilt axis (A) than a position (43) of said cam plate (23) extending between said points.

* * * * *